US010741001B2

(12) United States Patent
Bullock et al.

(10) Patent No.: US 10,741,001 B2
(45) Date of Patent: Aug. 11, 2020

(54) MODULAR BANKNOTE APPARATUS

(71) Applicant: Innovative Technology Limited, Oldham (GB)

(72) Inventors: Andrew Bullock, Oldham (GB); Michael Tillson, Oldham (GB)

(73) Assignee: Innovative Technology Limited, Oldham (GB)

( * ) Notice: Subject to any disclaimer, the term of this patent is extended or adjusted under 35 U.S.C. 154(b) by 0 days.

(21) Appl. No.: 16/171,512

(22) Filed: Oct. 26, 2018

(65) Prior Publication Data

US 2019/0333309 A1 Oct. 31, 2019

(30) Foreign Application Priority Data

Oct. 13, 2017 (GB) ..... 1716819.6

(51) Int. Cl.
*G07D 11/40* (2019.01)
*G07D 11/18* (2019.01)
*G07D 11/13* (2019.01)

(52) U.S. Cl.
CPC ..... *G07D 11/40* (2019.01); *G07D 11/13* (2019.01); *G07D 11/18* (2019.01)

(58) Field of Classification Search
CPC ..... G07D 11/16; G07D 11/18; G07D 11/40
USPC ..... 209/534
See application file for complete search history.

(56) References Cited

U.S. PATENT DOCUMENTS 6,315,279 B1 * 11/2001 Minamishin ..... G07F 19/20 271/3.15

FOREIGN PATENT DOCUMENTS

| | | | | |
|---|---|---|---|---|
| EP | 1261944 A2 * | 12/2002 | ..... | B65H 29/51 |
| GB | 2567626 A * | 4/2019 | ..... | G07D 11/40 |
| WO | WO 01/65493 A2 | 9/2001 | | |
| WO | WO-0165493 A2 * | 9/2001 | ..... | B65H 29/006 |

OTHER PUBLICATIONS

Search Report for GB 1716819.6 dated Mar. 26, 2018.

* cited by examiner

*Primary Examiner* — Terrell H Matthews
(74) *Attorney, Agent, or Firm* — Woodard, Emhardt, Henry, Reeves & Wagner, LLP

(57) ABSTRACT

A modular banknote apparatus (1) comprising: a banknote acceptor module (2); a banknote dispenser module (3); at least one banknote storage drum module (4); and a banknote transport module (5); wherein said banknote transport module (5) mechanically and electrically interconnects said at least one banknote storage drum module (4) and said banknote dispenser module (3); and wherein the banknote transport module (5) is configured to provide electronic control of both the banknote dispenser module (4) and the at least one banknote storage drum module (4) in a respective master and slave relationship.

18 Claims, 8 Drawing Sheets

MODULAR BANKNOTE APPARATUS

The present invention generally relates to an apparatus for receiving and dispensing currency documents. More specifically, the present invention relates to an apparatus configured to receive banknotes of various denominations and to accumulate and store validated banknotes for dispensing at a later date.

Apparatus for the handling of banknotes are widely used and are well known in various configurations and utilised in various applications. Examples of such applications comprise, inter alia, vending machines, gaming machines, financial transaction machines, etc.

Recently, to meet the operational needs of certain applications, it has become necessary to combine banknote validator/acceptor devices with banknote storage/recycler devices to facilitate multi-denomination payout operations, and to minimise the frequency of banknote replenishment operations.

EP-A-1,261,944 discloses a modular banknote apparatus comprising a banknote validator, a plurality of banknote accumulators, a banknote stacker/dispenser, and a banknote cassette. The banknote accumulators are interchangeable and are disposed around a central directing rotary switch that is configured to divert banknotes to one of the accumulators, to the banknote cassette, or to the banknote stacker/dispenser.

This banknote apparatus further includes a frame for slidably receiving the various modules, and a removable chassis which releasably supports the banknote accumulators and the banknote stacker/dispenser.

A similar banknote apparatus to that described in EP-A-1,261,944 is disclosed in EP-A-2,195,792. Here, four banknote accumulators are clustered around a central directing rotary switch, and a banknote stacker/dispenser module is cited between a banknote validator and the banknote accumulators.

US-A-2013/0186730 describes a banknote accumulator module that is configured to be releasably mounted to a banknote validator. The banknote accumulator module is adapted to receive banknotes from the validator for temporary storage, and to return stored banknotes to the validator for dispensing. In contrast to that which is described in EP-A-1,261,944 and EP-A-2,195,792, there is no separate banknote stacker/dispenser module.

The banknote accumulator module disclosed in US-A-2013/0186730 includes a conveyor mechanism for transporting banknotes from the accumulator module to the banknote validator, and for transporting banknotes received from the banknote validator to one of an upper and a lower storage drum. A belt device of the conveyor mechanism is housed within a cover section which, when released and pivoted away from the accumulator module, exposes a banknote pathway. In this way, it is possible to remove a jammed banknote from the pathway.

A problem associated with prior art apparatus as described in EP-A-1,261,944 and EP-A-2,195,792 is that the central banknote processing path is complex and requires the employment of rotary switching element comprising more than one drive belt. This is a costly solution to the problem of routing banknotes in a multi-accumulator apparatus and increases the likelihood of the occurrence of a banknote jamming event.

An additional problem arises with this type of conventional banknote apparatus in that it is necessary to include a separate controller unit to enable cooperative operation of the banknote validator, the banknote accumulators and the banknote stacker/dispenser module.

With the apparatus disclosed in US-A-2013/0186730, banknote storage capacity is limited to two individual drum devices, and it is not possible to process a banknote payout operation from either of these drum devices whilst the validator is receiving an input banknote. Likewise, the apparatus cannot receive a banknote whilst it is processing the payout of one or more banknotes from a drum device.

The present invention arose from an attempt to address the aforementioned problems associated with the prior art. It is an object of the present invention to provide a simplified modular banknote apparatus which additionally allows for easy remedial maintenance.

In accordance with the present invention there is provided a modular banknote apparatus as defined in claim 1.

Preferably, the banknote acceptor module is releasably connected to the banknote transport module and the banknote acceptor module is configured to provide electronic control of the banknote transport module in a master and slave relationship.

Preferably, the banknote transport module encloses a motorised banknote transport mechanism configured to transport banknotes between the banknote acceptor and the at least one banknote storage drum module. The transport mechanism is also configured to transport banknotes between the at least one banknote storage drum module and the banknote dispenser module.

Advantageously, the banknote transport module is detachable from the banknote dispenser module and includes a first independent integral motor. In addition, the at least one banknote storage drum module is independently detachable from the banknote transport module.

In a preferred embodiment, the modular banknote apparatus comprises a plurality of banknote storage drum modules, and each banknote storage drum of the plurality of banknote storage drum modules is independently detachable from the banknote transport module. Advantageously, any one of the plurality of banknote storage drum modules is interchangeable with a printer module.

Preferably, the banknote transport module includes a pivotable cover section which, when pivoted into an open position, exposes the motorised banknote transport mechanism. Advantageously, this facilitates easy access to the transport mechanism allowing for its removal and maintenance.

Preferably, the banknote transport module includes an internal banknote routing pathway, and the motorised bank note transport mechanism comprises at least one conveyor belt for transporting banknotes around the internal banknote routing pathway.

The motorised banknote transport mechanism is removable from said banknote transport module when the pivotable cover section is the open position.

Preferably, the modular banknote apparatus includes a banknote cashbox that is removably connected to the banknote dispenser module.

In a preferred embodiment of the modular banknote apparatus of the present invention, a banknote received by the banknote transport module from the banknote acceptor is transported by the transport module to a banknote storage drum module or to the banknote cashbox.

Preferably, the banknote dispenser module includes a second independent integral motor driving a second banknote transport mechanism arranged to transport a received banknote to a banknote retrieval aperture.

Preferably, the motorised banknote transport mechanism is an endless conveyor belt drive comprising a pair of opposed and parallel endless belts, and the motorised banknote transport mechanism is drivable in both forward and reverse directions.

Preferably, the banknote acceptor includes a first electronic controller and the banknote transport module includes a second electronic controller.

Preferably, the banknote transport module includes an auxiliary input aperture.

An embodiment of the present invention will now be described, by way of example only, with reference to the accompanying drawings, in which.

Figure 4:
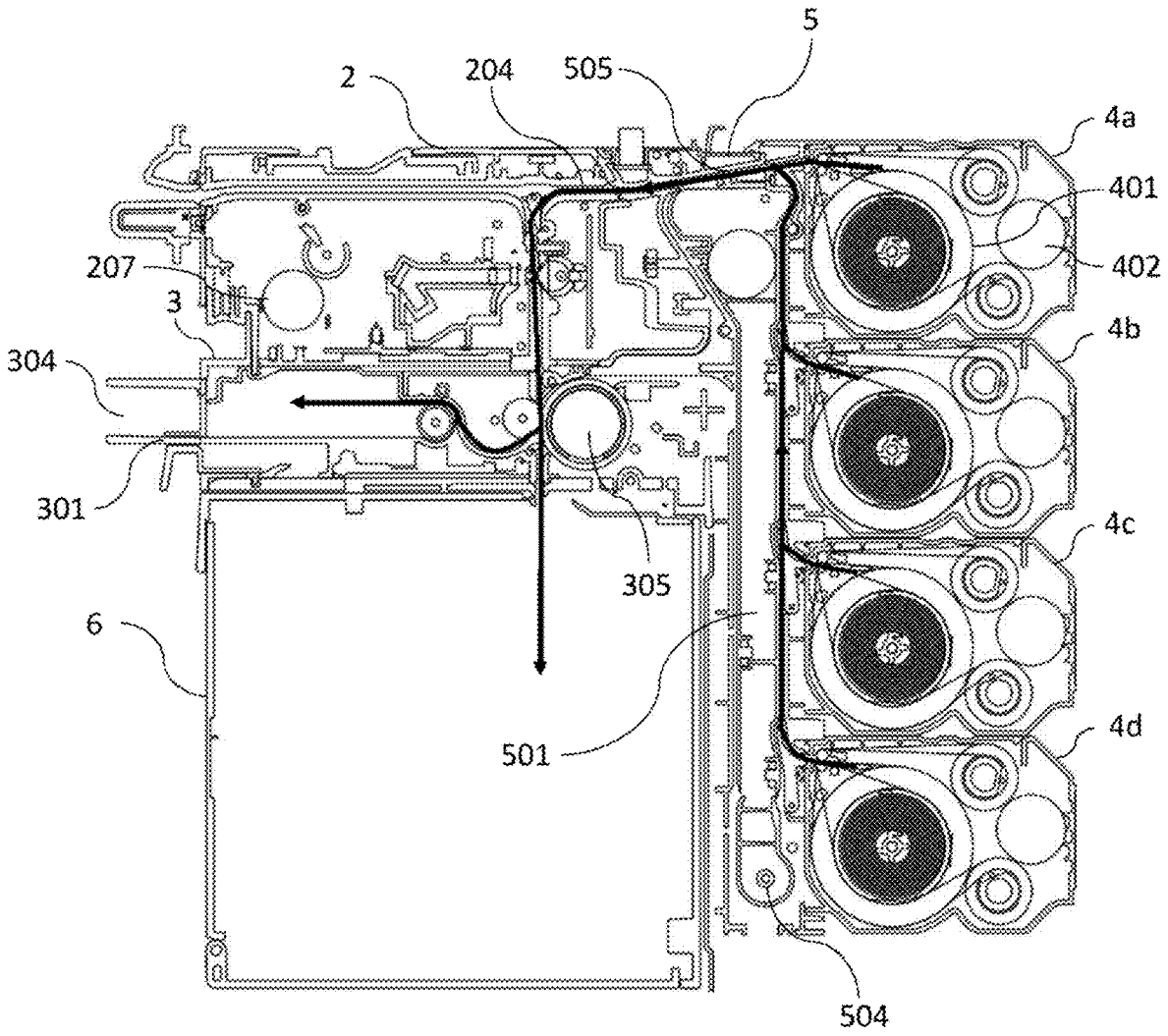
Figure 5:
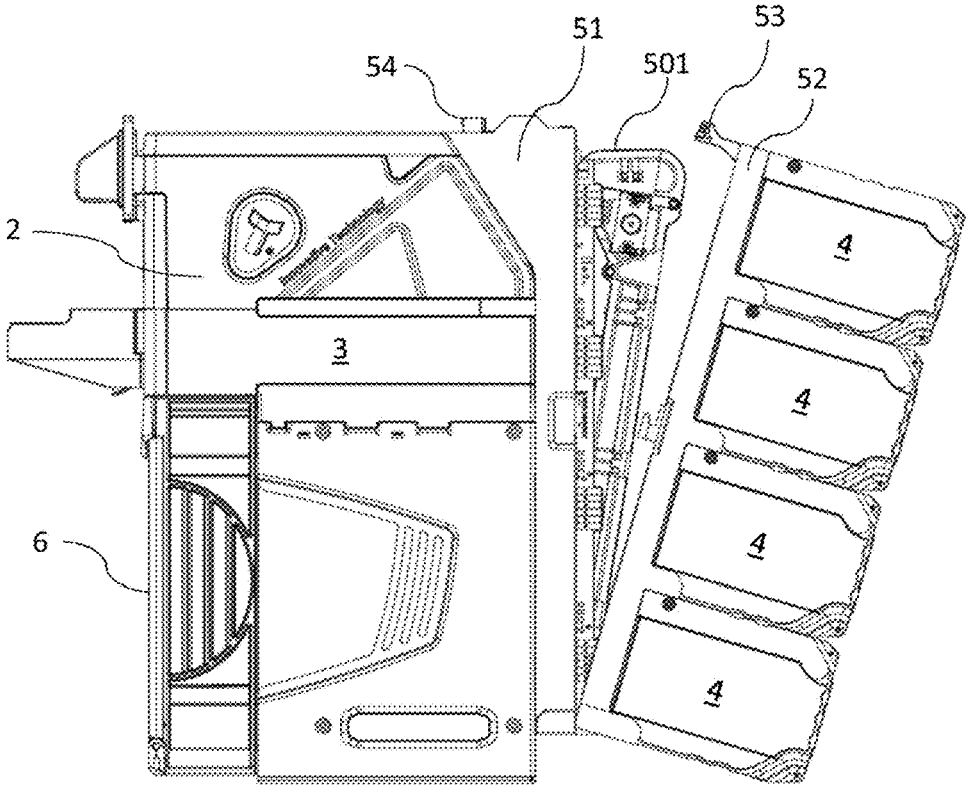
Figure 6:
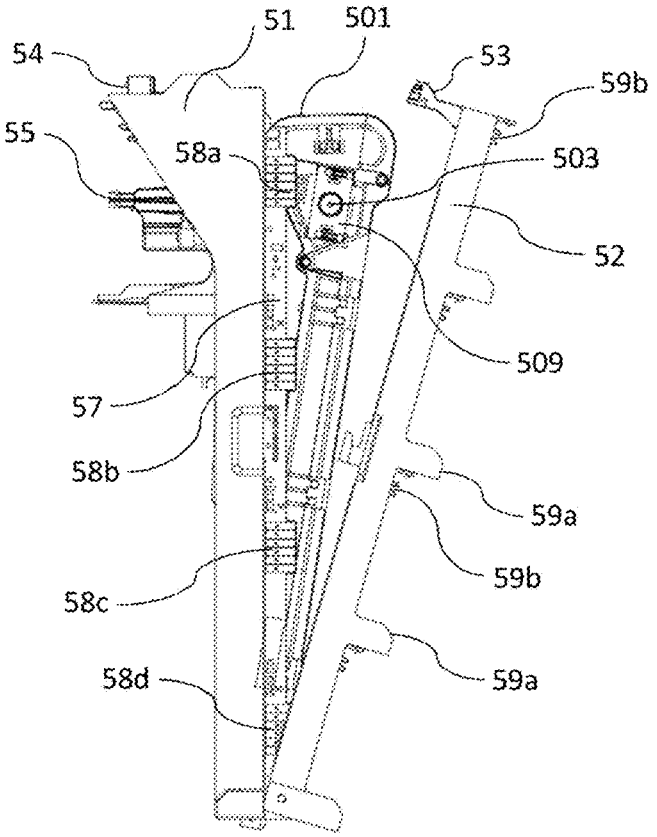
Figure 7:
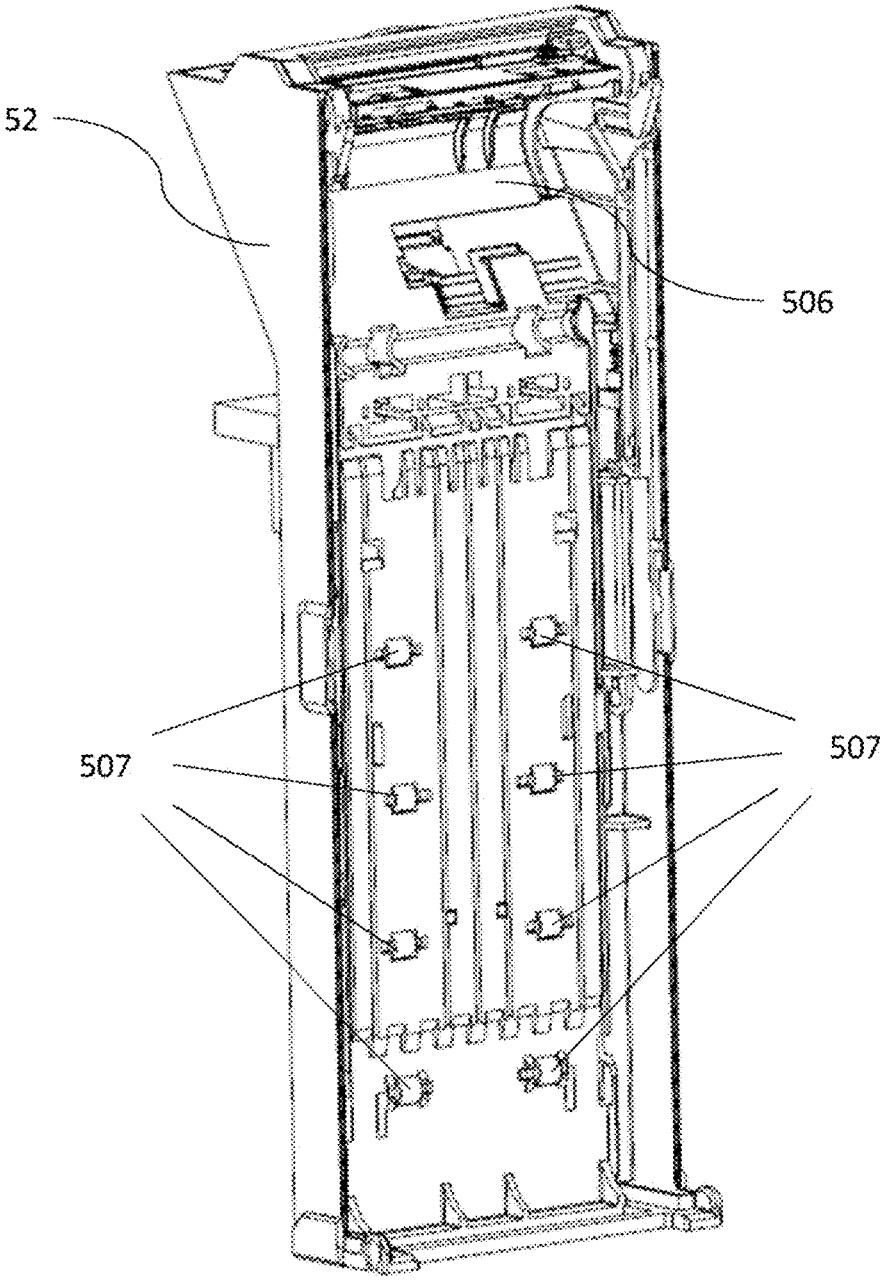
Figure 8A:
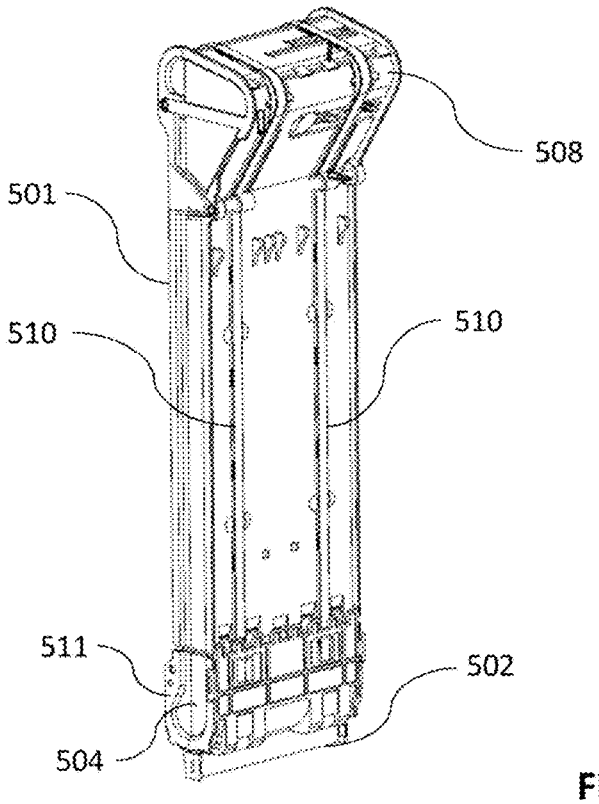
Figure 8B:
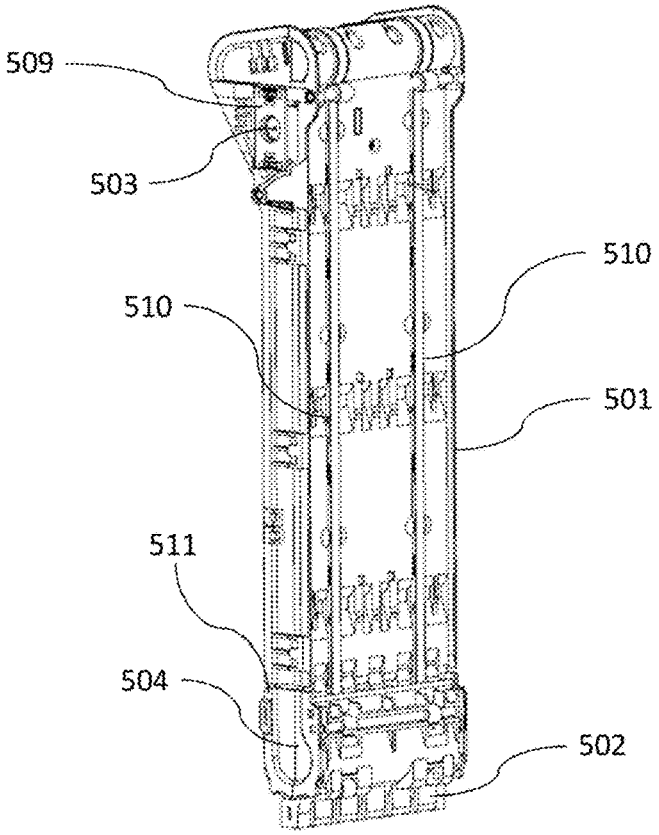
Figure 9A:
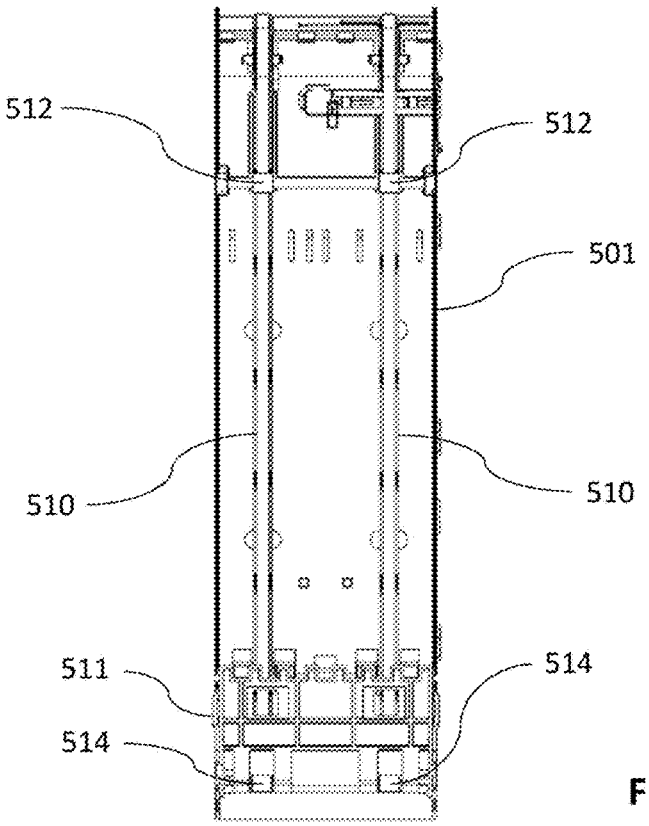
Figure 9B:
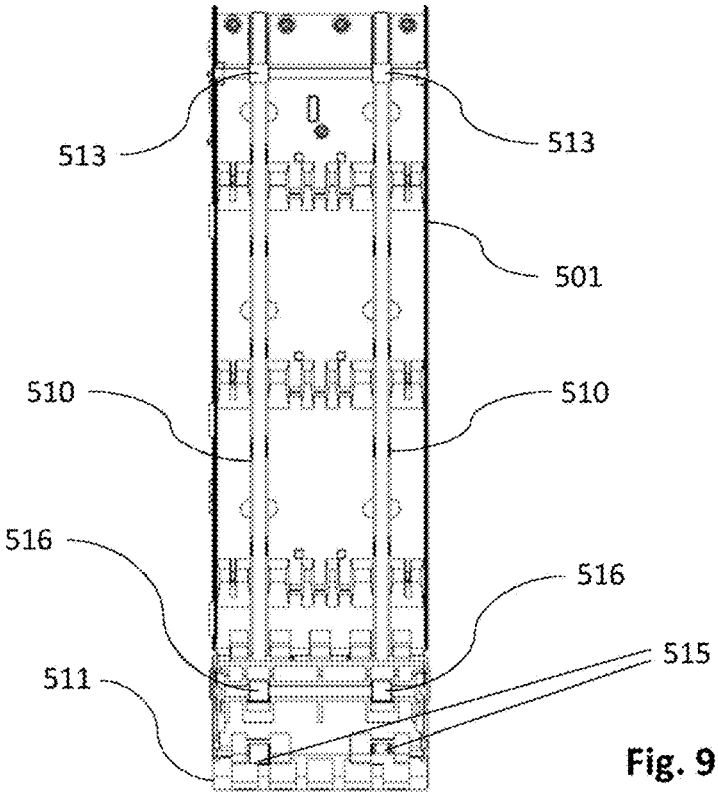

FIG. 4 a sectional elevation view of a modular banknote apparatus showing banknote paths to a dispenser module and to a cashbox respectively;

FIG. 5 is an elevation view of a modular banknote apparatus with a banknote transport module in an open position;

FIG. 6 is art elevation view of a banknote transport module in isolation and in an open position;

FIG. 7 is an elevation perspective view of the interior of the banknote transport module;

FIG. 8A is a front perspective view of a motorised banknote transport module;

FIG. 8B is a rear perspective view of a motorised banknote transport module;

FIG. 9A is a top plan view of a motorised banknote transport module;

FIG. 9B is bottom plan view of a motorised banknote transport module; and

Figure 10:
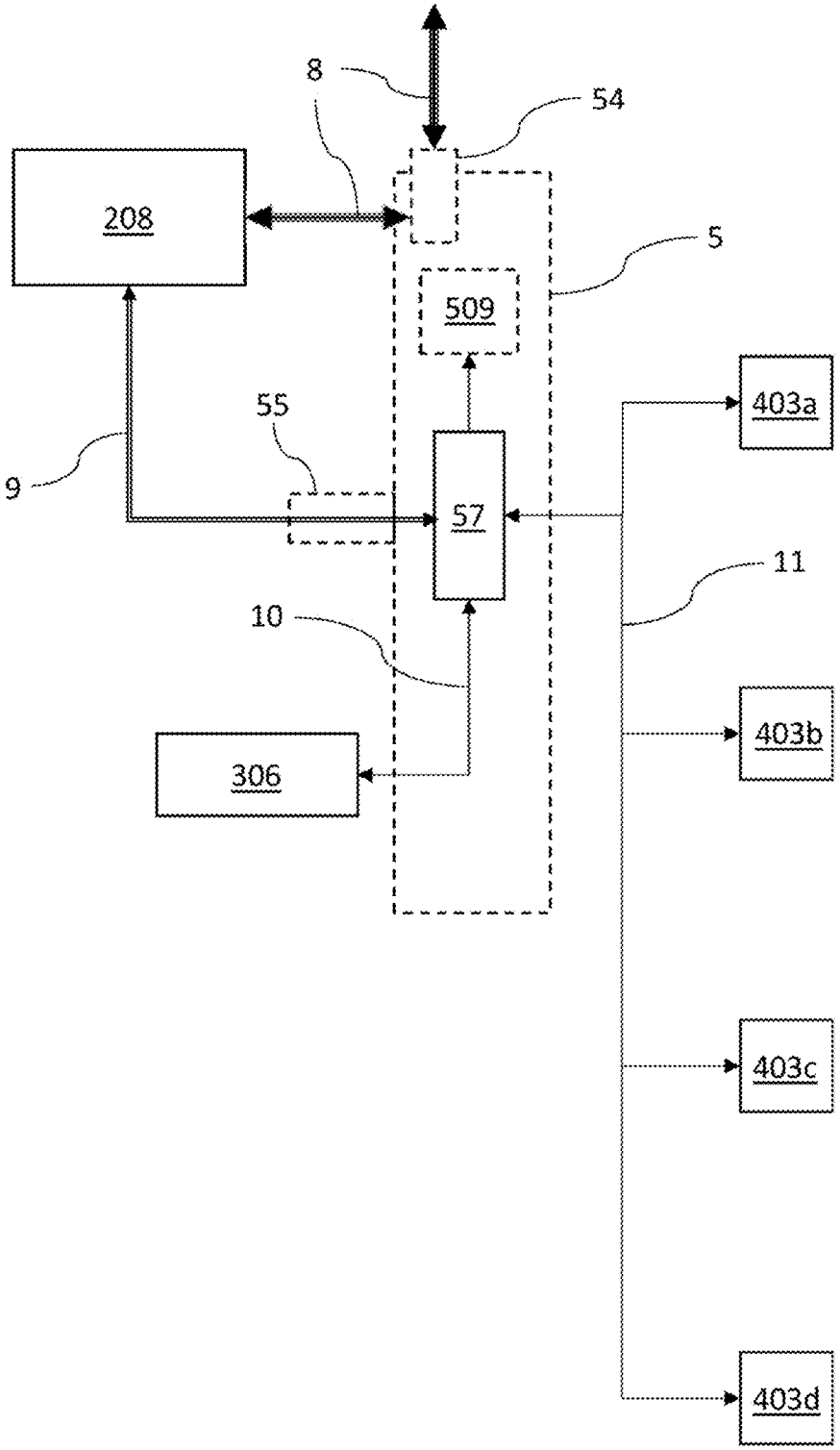

FIG. 10 is a schematic flow diagram showing control communication connections between constituent modules in the modular banknote apparatus.

Figure 1:
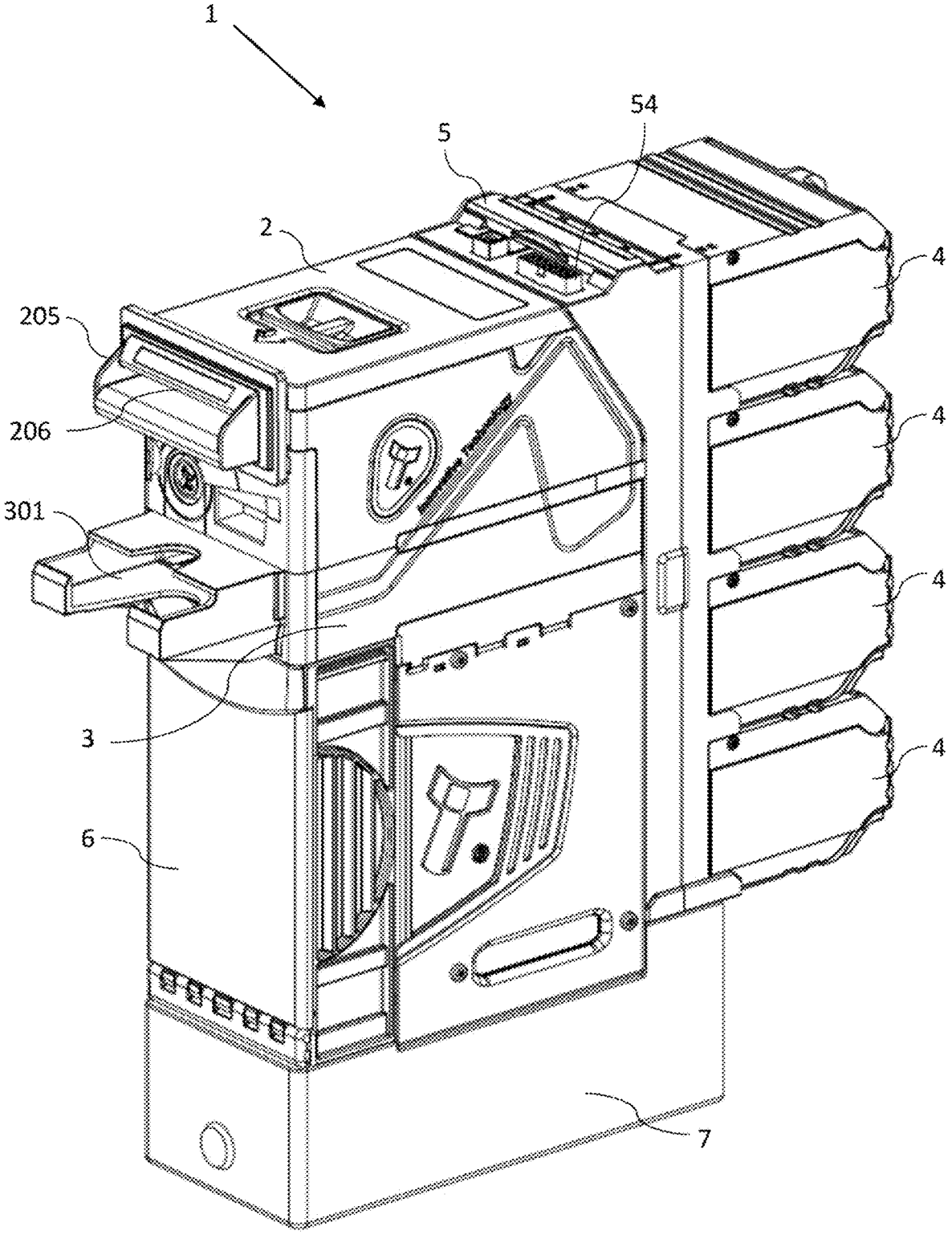
FIG. 1 shows a perspective view of a modular banknote apparatus.

As shown in FIG. 1, a modular banknote apparatus 1 of the present invention includes a banknote acceptor module 2, a banknote dispenser module 3, and a plurality of banknote storage drum modules 4.

The banknote acceptor module 2 is preferably a banknote validator of the type well known in the art. As shown, the banknote acceptor module 2 includes a bezel 205 through which banknotes can be fed via a banknote input aperture 206.

The banknote acceptor 2 is connected to the banknote dispenser module 3 and to a banknote transport module 5. The banknote transport module 5 interconnects the banknote acceptor 2 with four banknote storage drum modules 4. Although four drum modules are shown in FIG. 1, the reader should be aware that this is by way of example only, and that the number of banknote storage drum modules will depend upon the application or environment for which the apparatus 1 is intended.

The lower portion of the banknote transport module 5 is attached to a banknote cashbox 6. The connection between the transport module 5 and the banknote cashbox 6 provides mechanical support only, and there is no electrical connection or direct banknote pathway linking the banknote cashbox 6 and banknote transport module 5. As shown in FIG. 1, the banknote cashbox 6 is positioned beneath the banknote dispenser module 3.

The modular transport apparatus 1 shown in FIG. 1 includes an optional replenishment cassette 7 positioned beneath the cashbox 6. The replenishment cassette 7 is adapted to hold a reserve quantity of banknotes which, when required, can be transported from the replenishment cassette 7 into any of the banknote storage drum modules 4 via an auxiliary input aperture 502. The auxiliary input aperture 502 is located at an end of the banknote storage module 5 that is distal from the banknote acceptor module 2 (see FIGS. 2 to 4). The optional replenishment cassette 7 is can be removed from the modular transport apparatus 1 without having any effect on the normal operation of the apparatus.

The dispenser module 3 includes a dispenser tray 301 projecting from the front face of the dispenser module 3. The dispenser tray 301 receives banknotes from the dispenser module 3 and presents them in single or stacked formation for collection by a user. Typically, the dispenser tray 301 will extend through an aperture in a host machine into the exterior of the host machine. The host machine may, for example, be a gaming machine.

In a similar manner, the bezel 205 of the banknote acceptor 2, projects from the front face of the banknote acceptor 2. The bezel 205 extends outward into the exterior of the host machine. In this way, the input aperture 206 is disposed to receive banknotes from a user of the host machine.

As shown in FIG. 1, the banknote transport module 5 is located between the banknote acceptor 2 and the banknote storage modules 4. Each banknote storage module 4 is removably connected to the banknote transport module 5, and the banknote transport module 5 is in turn removably connected to the banknote acceptor module 2.

Each of the banknote storage drum modules 4 includes a tape drum 401 on which banknotes are held in the conventional way. The drive motors 402 each drive a respective the tape drum 401 in both clockwise and anticlockwise directions in a manner that will be familiar to the skilled reader (see FIGS. 2 to 4).

Figure 2:
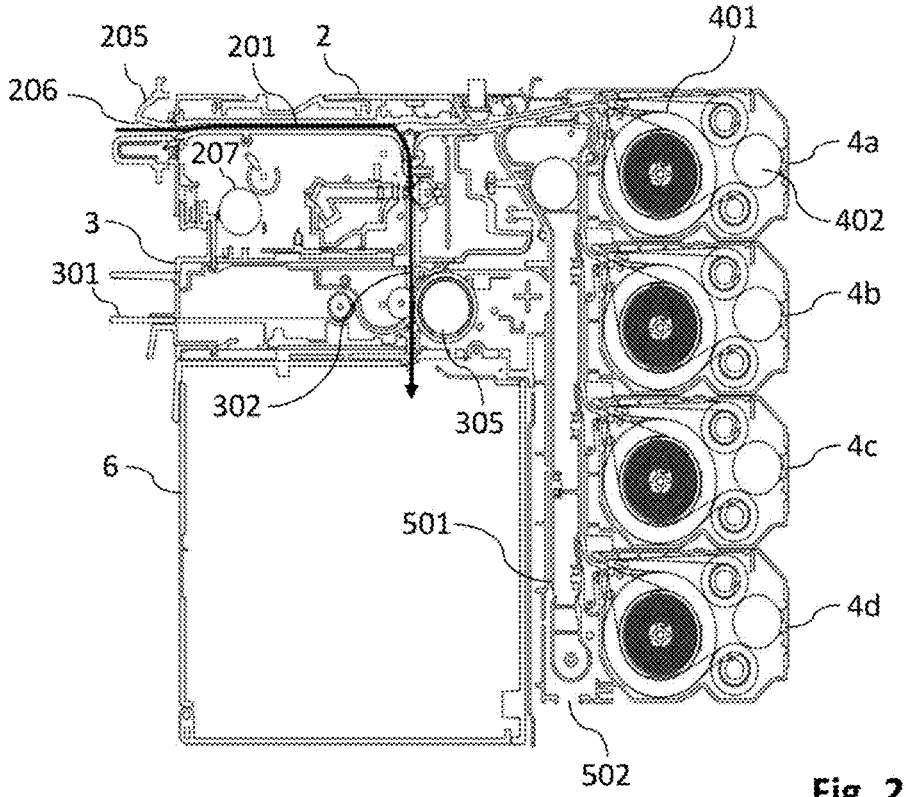
FIG. 2 is a sectional elevation view of a modular banknote apparatus showing a banknote input path.

As shown in FIG. 2, a banknote received via the input aperture 206 is transported along banknote transport pathway 201 passed a sensing means (not shown) which scans and analyses the banknote for authenticity and denomination determination. The received banknote is then held temporarily at banknote transport pathway position 302, before being routed to either the banknote cashbox 6 or to one of the plurality of banknote storage drum modules 4. If the authentication process has determined that the banknote is not acceptable it is returned to the input aperture 206 for collection by the user.

Alternatively, if analysis of the received banknote has determined that the banknote should be rejected, it is routed to the dispenser tray 301 from where it can be retrieved by the user.

Figure 3:
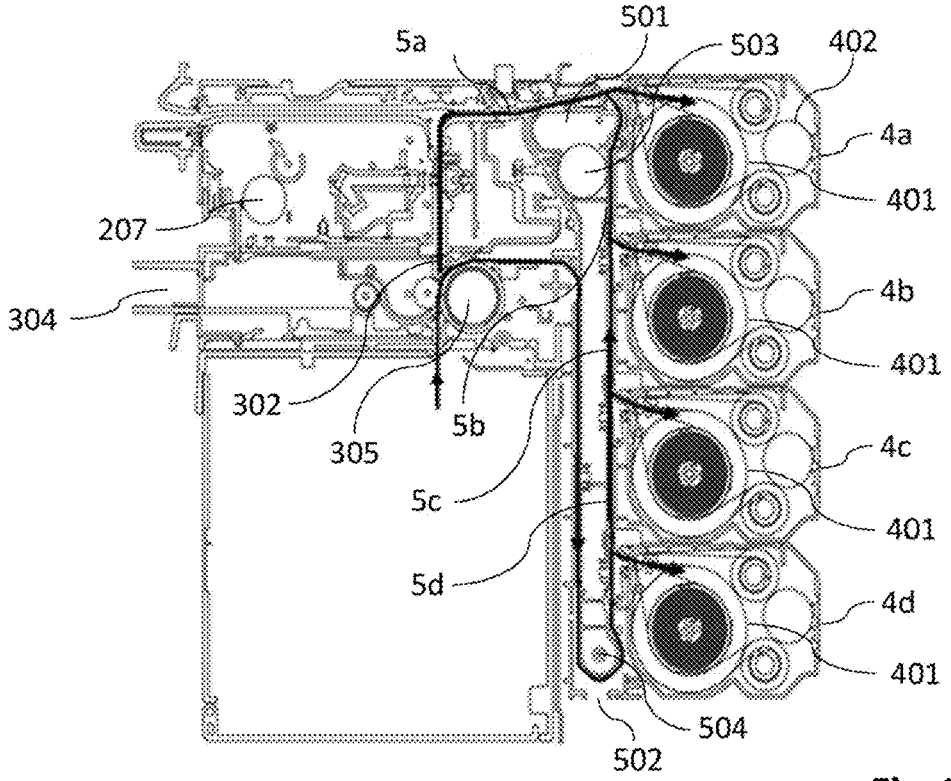
FIG. 3 is a sectional elevation view of a modular banknote apparatus showing banknote paths to storage drum modules.

FIG. 3 shows various banknote paths leading to each of the plurality of banknote storage drum modules 4. For clarity, in FIG. 3 each banknote drum module has been respectively labelled 4*a*, 4*b*, 4*c* and 4*b* to indicate the different denominations of currency that is to be stored on each drum module's respective tape drum 401. For example, module 4*a* stores €5 notes, module 4*b* stores €10 notes, module 4*c* stores €20 notes, and module 4*d* stores €50.

As shown, authentic banknotes destined for storage travel from the banknote transport pathway position 302 via operation of banknote dispenser motor 305. Banknotes determined to be unacceptable for reason of being fake, worn, out of circulation etc., can, in an alternative to that which is described above, be returned to a user via the input aperture 206 (pathway not shown). An acceptable banknote is transferred into the banknote transport mechanism 501 from where it is initially routed downwards towards transport belt wheel 504 via operation of transport module motor 503. Continued operation of the transport module motor 503 results in the banknote being routed upwards away from the transport belt wheel 504 towards the banknote storage drum modules 4.

A banknote determined to be an authentic €50 note, for example, may be destined for banknote storage drum module 4*d*. The €50 note will be transported until its trailing edge has reached point 5*d* in the banknote transport module pathway. Point 5*d* sits above a passive diverter and an associated sensor for detecting the presence of the passage of the trailing edge of the note (neither shown). A signal triggered by the sensor stops the transport module motor 503 and activates a motor reverse drive operation. Consequently, the €50 note is routed downwards and into banknote storage drum module 4*d* via the combined operation of the banknote transport mechanism 501 and the passive diverter guiding the note into the module 4*d*.

In a similar manner, €20 notes and €10 notes are deposited into respective banknote storage drum modules 4*c* and 4*d*. Here, the accepted notes are transported to respective stop points 5*c* and 5*d* in the transport module pathway and, in a similar manner to that which is described above in relation to an acceptable €50 note, are routed into respective banknote storage drum modules 4*c*, 4*d*.

If the received banknote is an authentic €5 note, it will be destined for deposit within banknote storage drum module 4*a*. The €5 note is routed until its trailing edge triggers a sensor located proximal to stop point 5*a* in the transport module pathway. In a similar manner as described above, the transport module motor 503 reverses the banknote transport mechanism 501 and routes the €5 note into storage drum module 4*a* via guidance by an associated passive diverter (not shown).

In the situations described above, banknotes received in any of the banknote storage drum modules 4 are stored on a respective tape drum 401 in a conventional manner via operation of a respective integral drive motor 402.

FIG. 4 depicts banknote transport routes for banknotes that are destined to be either paid out to a user via dispenser module 3, or ones that are to be stored in the banknote cashbox 6.

Banknotes are transferred from their respective tape drum 401 to the banknote transport mechanism 501 via operation of the respective integral drive motor 402. A €50, €20 or €10 banknote received by the banknote transport mechanism 501 is then transported upwards away from the transport belt wheel 504 by operation of the transport module motor 503 to transverse pathway branch 505. A €5 note dispensed from the banknote storage drum module 4*a* is received directly into the transverse pathway branch 505.

Once a banknote reaches the transverse pathway branch 505 it is routed into a rearward branch 204 of the banknote acceptor module pathway 201 of the banknote acceptor module 2. From here the banknote is routed downwards via operation of the acceptor module motor 207 towards the dispenser module 3. The transportation of banknotes within a conventional banknote acceptor module in this manner is well known in the art and will not be described further here.

Any banknote intended to be stored in the banknote cashbox 6 is routed through the dispenser module 3 via operation of the banknote dispenser motor 305. The banknote received in the cashbox 6 is stacked and stored in any one of the conventionally known ways. Typically, the banknote will be received in the cashbox 6 by a stacker mechanism which in turn will stack the received banknote onto an existing bundle of stored banknotes.

A banknote which is to be dispensed from the modular banknote apparatus 1 is routed, via operation of the banknote dispenser motor 305 and an actively driven diverter (not shown), into the dispenser tray 301. From here the banknote can be retrieved through dispensing aperture 304 by a user. In some instances, a user will retrieve a plurality of banknotes from the dispenser module 3 in the form of a bundle of notes. The bundle of banknotes is formed by stacking each of the plurality of banknotes in turn as they are received in the dispenser tray 301.

With reference to FIG. 5, the banknote transport module 5 comprises a first housing section 51 pivotally connected to a cover section 52. In normal operation, the first housing section 51 is releasably locked to the cover section 52 (see FIG. 1). If a problem occurs with the banknote transport mechanism 501, for example a banknote becomes jammed, then an authorised operative can gain access to the banknote transport mechanism 501 by releasing catch 53 allowing the cover section 52 to pivot away from the first housing section 51 exposing the transport mechanism 501. Advantageously, an operative can not only remove a jammed banknote by opening the banknote transport module 5, he or she can remove the entire banknote transport mechanism 501 from the banknote transport module 5 to inspect it and conduct any necessary maintenance of the banknote mechanism 501.

FIG. 6 illustrates the banknote transport module 5 of FIG. 5 detached from the banknote acceptor module 2. The figure also shows the banknote transport module 5 in a state in which all of the banknote storage drum modules 4 having been removed. The reader should be aware that any individual banknote storage drum module can, as required, be removed, re-attached or substituted with minimal effort due to the construction of the banknote transport modules 5.

As shown in FIG. 6, a first housing section 51 of the banknote transport module 5 includes a first electronic interface 54 and a second electronic interface 55. The first electronic interface 54 facilitates communication to and from a host machine (not shown). The first electronic interface 54 can also optionally receive power input directly from the host machine.

The second electronic interface 55 enables two-way communication between the banknote transport module 5 and the banknote acceptor module 2. The banknote acceptor module 2 may receive power input through the second electronic interface 55 or it can receive power directly from the first electronic interface 54. However, it should be noted that command and control signals from the host machine are directed directly to the banknote acceptor module 2 through the first electronic interface 54. Likewise, communications from the banknote acceptor module 2 to the host machine are sent via the first electronic interface and such communications by-pass the banknote transport mechanism 501.

A first housing section 51 of the banknote transport module 5 includes a male docking platform 56 to mechanically engage and releasably mate with a corresponding female receiving portion located on a rearward face of the dispenser module 3 (not shown). In this way, the dispenser module 3 can be releasably locked to the banknote transport module 5. Consequently, the banknote acceptor module 2 is provided with mechanical support from both the dispenser module 3 and the banknote transport module 5 (see FIG. 5).

The second electronic interface 55 is in electrical communication with a transport module PCB 57. The transport module PCB 57 includes a plurality of drum module connectors 58. Each drum module connector, individually labelled 58*a*, 58*b*, 58*c* and 58*d*, interconnects with a respective communications socket provide on each of the respectively corresponding banknote storage drum modules 4*a*, 4*b*, 4*c*, and 4*d*. When the banknote transport module 5 is in the open position (FIG. 5) electrical connection between respective drum module connectors 58 and drum modules 4 is broken. Conversely, closing the banknote transport module 5 (FIG. 1) automatically re-establishes electrical connection between drum module connectors 58 and respective drum modules 4.

As shown in FIG. 6, the cover section 52 includes a plurality of cantilevered receptacle structures 59*a*. Each receptacle structure 59*a* is located and configured to provide mechanical engagement and support for a banknote storage drum module 4. In an alternative embodiment of the present invention any of the receptacle structures 59*a* can be configured to releasably engage a printer module (not shown) and/or a banknote storage drum module 4.

The banknote transport module cover section 52 also includes a plurality of banknote pathway input apertures 59*b*. Each banknote pathway input aperture 59*b* is releasably engageable with a corresponding banknote pathway aperture disposed on a banknote transport module 4 or, when present, a corresponding printer module paper pathway aperture.

In the closed position, the banknote transport module 5 provides a continuous banknote pathway between each banknote transport module 4 and the banknote transport mechanism 501.

FIG. 7 shows a perspective view of the first housing section 51 with the banknote transport mechanism 501 and the transport module PCB 57 removed.

The first housing section 51 includes a recess area 506 for receiving a salient portion 508 of the banknote transport mechanism 501 (see FIGS. 8A and 8B). The first housing section 51 also includes a plurality of transport wheels 507 which cooperate with transport mechanism belts 510 when the banknote transport mechanism 501 is located within the banknote transport module 5.

With reference to FIGS. 8A and 8B, a salient portion 508 of the banknote transport mechanism 501 houses the transport module motor 503, and two opposing pairs of transport belt wheels (not shown). The transport motor 503 and the two opposing pairs of transport belt wheels, in conjunction with transport belt wheels 504, drive the transport mechanism belts 510 in a manner which will be known to a skilled reader.

A transport mechanism PCB 509 is disposed on an outer surface of the salient portion 508. The transport mechanism PCB 509 is in direct electrical communication with the transport module motor 503. The transport mechanism PCB 509 is positioned such that when the banknote transport mechanism 501 is located and housed within the banknote transport module 5, and the banknote transport module 5 is in a closed position, the transport mechanism PCB 509 is in electrical connection with the transport module PCB 57. In this way, the banknote transport mechanism 501 is controlled by the transport module PCB 57.

A lower section 511 of the banknote transport mechanism 501, a portion distal from the salient portion 508, houses the pair of transport belt wheels 504. The transport mechanism belts 510 extend between the transport belt wheels of the salient portion 508 and the transport wheels 504 of the lower section 511. The lower section 511 of the banknote transport mechanism 501 includes the auxiliary input aperture 502. The auxiliary input aperture 502 is arranged to communicate with the cash reserve cassette 7 or other optional auxiliary device. For example, if a printer module is required and, if replacing one of the banknote storage drum modules with a printer module is not possible or desired, then a printer module could be attached and arranged such that it is in communication with the auxiliary input aperture 502.

FIGS. 9A and 9B respectively show a front elevation view and a rear elevation view of the banknote transport mechanism 501. FIG. 9A indicates the relative positions of guide rollers 512 and 514. FIG. 9B illustrates the relative positions of guide rollers 513, 515 and 516. The guide rollers 512 to 515 are arranged to provide suitable pinch-points along the banknote pathway that circulates around the outer periphery of the banknote transport mechanism 501. The skilled reader will be aware that banknotes travel with one surface in contact with the transport mechanism belts 510 and the opposing surface periodically coming into contact with the underside of the guide rollers as the banknote traverses the banknote transport mechanism pathway.

The electronic communications relationship between the various modules of apparatus of the present invention will now be described with reference to FIG. 10.

Two-way electronic communication 8 between the host machine (not shown) and an acceptor module PCB 208 is routed via the first electronic interface 54.

Two-way electronic communication 9 between the acceptor module PCB 209 and the transport module PCB 57 is routed via the second electronic interface 55. The relationship between the acceptor module PCB 209 and the transport module PCB 57 in terms of instructions is one of master-and-slave where the PCB 57 receives operation instructions from PCB 209.

The transport module PCB 57 is in two-way electronic communication 10 with a dispenser module PCB 306. Similarly, the transport module PCB 57 is in two-way electronic communication 11 with each of a plurality of storage drum PCBs 403*a*, 403*b*, 403*c*, and 403*d*. The relationship between the transport module PCB 57 and the dispenser module PCB 306 in terms of instructions is one of master-and-slave where the PCB 306 receives operation instructions from PCB 306. Similarly, the relationship between the transport module PCB 57 and each of the storage drum PCBS 403*a*, 403*b*, 403*c*, and 403*d* in terms of instructions is one of master-and-slave where the storage drum PCBs receive operation instructions from PCB 209.

In should be understood that although instructions are one-way in a master/slave relationship, communication is nevertheless two-way between a master PCB and a slave PCB, since the slave PCB will send confirmation signals back to the master PCB that an instruction has been executed or signals identifying the status of various devices.

For example, PCB 208 receives an instruction from the host to dispense €185. PCB 208 in turns sends an instruction to PCB 57 to remove this amount of cash from the banknote storage drum modules 4. In one embodiment, the instruction from PCB 208 will contain information as to which denomination of banknotes are to be used to make up this amount. In an alternative embodiment, PCB 57 determines the relevant denominations.

PCB 57 returns a signal to PCB 208 that the instruction has been received and then in turn sends instructions, in an appropriate order, to the relevant storage drum PCBs to commence a dispensing function.

PCB 57 controls operation of the banknote transport mechanism 501 via the transport mechanism PCB 509. In this way, the correct number and denomination of banknotes are routed from the banknote storage drum modules 4 to the banknote dispenser module 3. Operation of the transport module 3 is controlled by PCB 57 via communication with the dispenser module PCB 306.

A signal is sent from PCB 57 to PCB 208 confirming that €185 has been deposited into dispenser tray 301. PCB 208 will then undertake the appropriate communication with the host machine indicating that the payout procedure has been executed.

The reader should be aware that all the above discussed PCBs include some type of processing device to execute instructions etc. The processing device can be a single processor or many processors. These processing devices can be implemented as microprocessors, microcomputers or any type of central processing unit as required. Whichever processing device is employed it will be capable of executing computer-readable instructions and reading data stored in memory.

Advantageously, the modular banknote apparatus of the present invention not only provides a plurality of banknote storage devices that are removable and interchangeable, either with one another or with another auxiliary device, it also provides a simple and compact transport module that facilitates easy access for maintenance and comprises a modular transport mechanism that, if required, can be removed and replaced with minimal intervention or disruption to the apparatus as a whole.

A further advantage arises in that the compact transport module acts as a master in relation to the control of the banknote storage drum modules and the banknote dispenser module, thus minimising the amount of adaption that is required in order to configure a conventional banknote acceptor module to be compatible with the various modules of the present invention.

The invention claimed is:

1. A modular banknote apparatus comprising:

a banknote acceptor module;

a banknote dispenser module;

at least one banknote storage drum module; and a banknote transport module;

wherein said banknote transport module mechanically and electrically interconnects said at least one banknote storage drum module and said banknote dispenser module, and said banknote transport module includes a transport module PCB; and wherein the banknote transport module is configured to provide two-way electronic control of both the banknote dispenser module and the at least one banknote storage drum module in a respective master and slave relationship via a dispenser module PCB and a storage drum module PCB respectively.

2. A modular banknote apparatus as claimed in claim 1, wherein the banknote acceptor module is releasably connected to the banknote transport module, and wherein said banknote acceptor module is configured to provide electronic control of the banknote transport module in a master and slave relationship.

3. A modular banknote apparatus as claimed in claim 1, wherein said banknote transport module encloses a motorised banknote transport mechanism configured to transport banknotes between said banknote acceptor and said at least one banknote storage drum module, and to transport banknotes between said at least one banknote storage drum module and said banknote dispenser module.

4. A modular banknote apparatus as claimed in claim 1, wherein the banknote transport module is detachable from the banknote dispenser module and includes a first independent integral motor.

5. A modular banknote apparatus as claimed in claim 4, wherein the at least one banknote storage drum module is independently detachable from the banknote transport module.

6. A modular banknote apparatus as claimed in claim 1, wherein the apparatus comprises a plurality of banknote storage drum modules, and wherein each banknote storage drum of the plurality of banknote storage drum modules is independently detachable from the banknote transport module and is interchangeable with a printer module.

7. A modular banknote apparatus as claimed in claim 1, wherein the banknote transport module includes a pivotable cover section which, when pivoted into an open position, exposes the motorised banknote transport mechanism.

8. A modular banknote apparatus as claimed in claim 7, wherein the banknote transport module includes an internal banknote routing pathway, and wherein the motorised bank note transport mechanism comprises at least one conveyor belt for transporting banknotes around the internal banknote routing pathway.

9. A modular banknote apparatus as claimed in claim 7, wherein the motorised banknote transport mechanism is removable from said banknote transport module when the pivotable cover section is the open position.

10. A modular banknote apparatus as claimed in claim 1, wherein the apparatus includes a banknote cashbox.

11. A modular banknote apparatus as claimed in claim 10, wherein the banknote cashbox is removably connected to the banknote dispenser module.

12. A modular banknote apparatus as claimed in claim 11, wherein a banknote received by the banknote transport module from the banknote acceptor is transported by the transport module to either the at least one banknote storage drum module or to the banknote cashbox, wherein banknote transport to the banknote cashbox is via the banknote dispenser module.

13. A modular banknote apparatus as claimed in claim 1, wherein the banknote dispenser module includes a second independent integral motor driving a second banknote transport mechanism arranged to transport a received banknote to a banknote retrieval aperture.

14. A modular banknote apparatus as claimed in claim 9, wherein the motorised banknote transport mechanism is an endless conveyor belt drive.

15. A modular banknote apparatus as claimed in claim 14, wherein the endless conveyor belt drive comprises a pair of opposed and parallel endless belts.

16. A modular banknote apparatus as claimed in claim 15, wherein the motorised banknote transport mechanism is drivable in both forward and reverse directions.

17. A modular banknote apparatus as claimed in claim 1, wherein the banknote acceptor includes a first electronic controller and the banknote transport module includes a second electronic controller.

18. A modular banknote apparatus as claimed in claim 1, wherein the banknote transport module includes an auxiliary input aperture.

* * * * *